United States Patent [19]

Iwata et al.

[11] Patent Number: 4,954,675

[45] Date of Patent: Sep. 4, 1990

[54] SWITCH OPERATION INDICATOR

[75] Inventors: Masayosi Iwata; Toshiya Muto; Minoru Morikawa; Satoshi Kozawa; Akihiko Takase; Naoki Terano, all of Aichi, Japan

[73] Assignee: Kabushiki Kaisha Tokai Rika Denki Seisakusho, Aichi, Japan

[21] Appl. No.: 244,373

[22] Filed: Sep. 14, 1988

[30] Foreign Application Priority Data

Sep. 18, 1987 [JP] Japan ..... 62-143505[U]
Sep. 18, 1987 [JP] Japan ..... 62-143506[U]

[51] Int. Cl.[5] ..... H01H 9/16
[52] U.S. Cl. ..... 200/317
[58] Field of Search ..... 200/317, 312, 311, 310, 200/314, 308; 116/279, DIG. 5, DIG. 26, DIG. 28

[56] References Cited

U.S. PATENT DOCUMENTS 2,260,592 10/1941 Winning ..... 200/317 X
3,576,175 4/1971 Gammill ..... 116/279
4,661,667 4/1987 Sorimachi et al. ..... 200/314

FOREIGN PATENT DOCUMENTS 1164057 9/1969 United Kingdom ..... 200/317

*Primary Examiner*—Renee S. Luebke
*Attorney, Agent, or Firm*—Finnegan, Henderson, Farabow, Garrett and Dunner

[57] ABSTRACT

A switch operation indicator is disclosed which comprises a frame fitted with a push-type switch having a drive member which is locked into a pressed-in position by a first pressing action and unlocked to return to an original position by the next pressing action; a push button fitted in the panel of the frame so that the button can be pressed in; a coupling bar which couples the button and the drive member to each other and has an operating notched portion; an indication opening provided in the panel adjacently to the button and an indication member attached to the frame so as to be swung, along with the movement of the bar, to be engaged with or disengaged from the notched portion and is provided with an indicating portion which alternatively faces or does not face the opening as the indication member is swung back and forth by the repeated pressing actions. Alternatives include an optical guiding version and a vibration-clamping version.

3 Claims, 7 Drawing Sheets

SWITCH OPERATION INDICATOR

BACKGROUND OF THE INVENTION

The present invention relates to a switch operation indicator in which an indication member is mechanically swung to face, or is displaced from an indication opening to indicate the operation of a switch.

A push-type switch, which is turned on and off alternately by repeatedly pressing of a push button, is provided with a conventional switch operation indicator including a light emitting diode near the push button so as to indicate the turned-on state of the switch. Therefore, special circuitry for turning on and off the light emitting diode and a mechanical construction for holding the diode need to be provided in the switch operation indicator. As a result, the switch construction and operation is unduly complicated.

SUMMARY OF THE INVENTION

The present invention is made in order to simplify the switch operation indicator.

Accordingly, it is an object of the present invention to provide a switch operation indicator which indicates the operated state of a push-type switch through the use of a mechanical construction so as to simplify the construction and operation of the switch operation indicator.

The switch operation indicator is characterized in that the push button is supported for operation; and a coupling bar couples the push button and the drive member of the switch to each other and is provided with an operating notched portion. An indication opening is provided in the panel adjacent to the push button. An indication member is swung along with the movement of the coupling bar so as to be engaged with (the On position) or disengaged from (the Off position) the operating notched portion of the coupling bar and is provided with an indicating portion which faces (the On position) or does not face (the Off position) the indication opening, successively, each respective reversed with swing of the indication member. The indicating portion faces or does not face the indication opening in response to the turning-on or turning-off of the push-type switch, to indicate the turning-on or turning off thereof not by using an electric construction but by using the mechanical indication member. For that reason, construction and operation of the switch operation indicator is simplified.

DESCRIPTION OF THE PREFERRED EMBODIMENTS

Embodiments of the present invention are hereafter described in detail with reference to the drawings.

Figure 1:
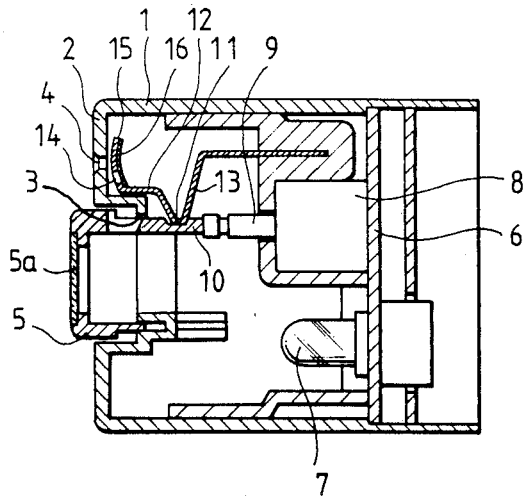
FIG. 1 is a sectional view taken along the line I—I of FIG. 2, showing a switch operation indicator according to an embodiment of the present invention.
Figure 2:
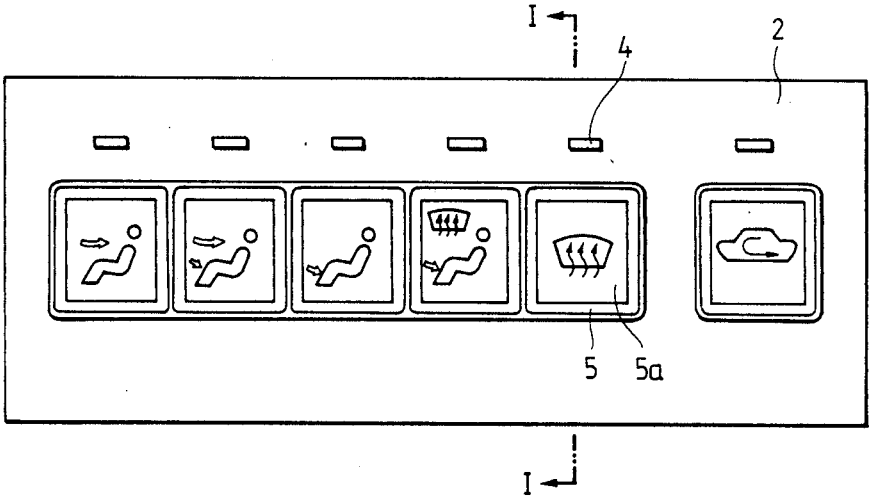
FIG. 2 shows a front view of the switch operation indicator.
Figure 3:
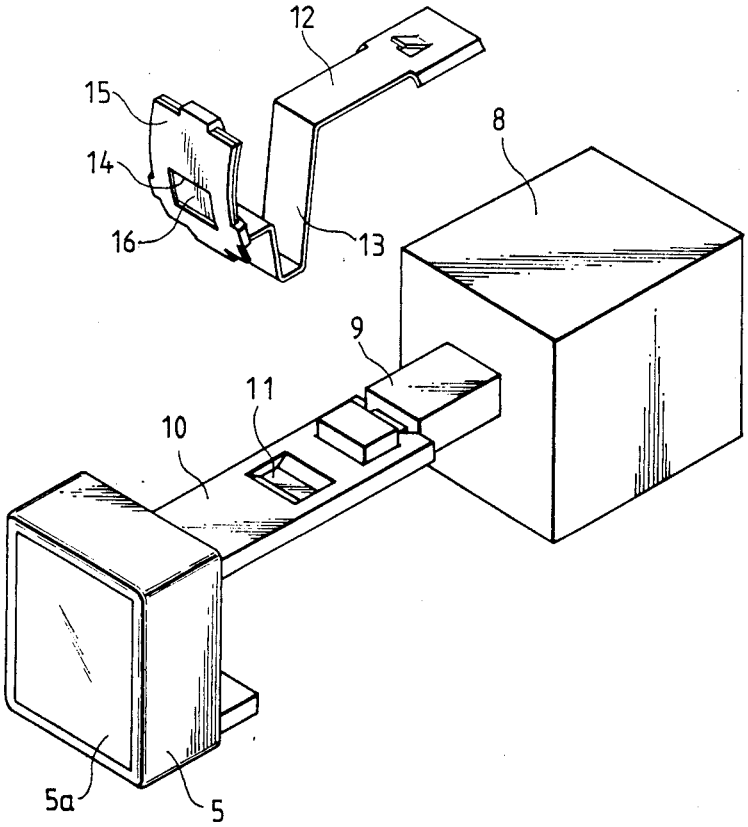
FIG. 3 is an enlarged perspective view showing a major part of the switch operation indicator.
Figure 4A:
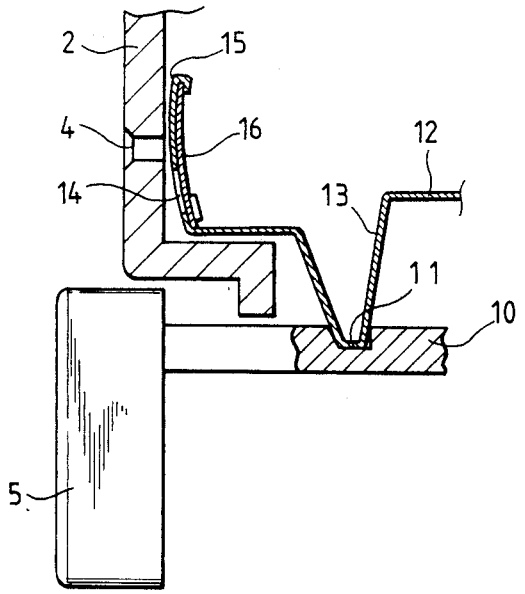
FIGS. 4A and 4B are views illustrating the operation of the switch operation indicator.

FIGS. 1, 2, 3, 4A and 4B show a switch operation indicator which is one of the embodiments. The switch operation indicator comprises a frame 1 made of a plastic material, for example, and having a front panel 2, push button support holes 3 provided in the panel, indication openings 4 provided in the panel over the push button support holes, and a lamp cover 6 constituting a rear portion of the frame. Push buttons 5 shaped nearly as a square in cross section and having indicating portions 5*a* made of a light-transmissible plastic material, for example, are slidably fitted in the push button support holes 3. A lamp 7 and push-type switches 8 are provided on the lamp cover 6. When the forwardly projecting drive member 9 of each of the push-type switches 8 is pressed in once, the member is locked in the pressed-in position and the switch is turned on. When the drive member 9 is pressed in again, it is unlocked and returned to its original position and the switch 8 is turned off. A coupling bar 10 is integrally formed on the rear of each of the push buttons 5 and engaged at the rear end of the bar with the drive member 9 of the push-type switch 8. A notch 11 is provided in the top of the nearly central portion of the coupling bar 10. Indication members 12 each made of a spring steel plate, for example, are secured at the rear ends of the members to the lamp cover 6 and have V-shaped operating central portions 13 whose bottoms are located in contact with the tops of the coupling bars 10. The tips of the indication members 12 are integrally provided with holders 15 having through holes 14 corresponding to the indication openings 4. Indication films 16 each made of a colored plastic material, for example, are adhered on the backs of the holders 15 over through holes 14. When the push button 5 is forwardly protruded in an original position as shown in FIGS. 1 and 4A, the push-type switch 8 is turned off and the operating portion 13 of the indication member 12 is engaged in the notch 11 of the coupling bar 10. At that time, the portion of the holder 15, which extends above the through hole 14 thereof, faces the indication opening 4 so that nothing is indicated through the opening.

Figure 4B:
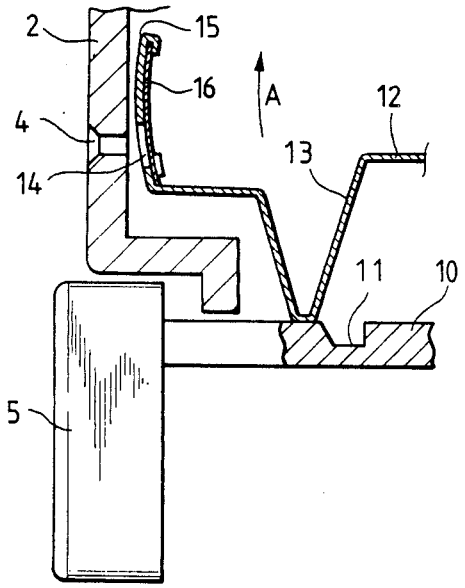

The operation of the switch operation indicator is described in a more detailed manner hereinafter. When the push button 5 is forwardly protruded in the original position as shown in FIGS. 1 and 4A, the switch 8 is turned off and the portion of the holder 15, which extends above the through hole 14, faces the indication opening 4 so that nothing is indicated through the opening. If the lamp 7 is lit, for example, at night, light from the lamp passes through the push button 5 to indicate the position thereof but does not pass through the indication opening 4, so that the colored indication film 16 cannot be seen through the indication opening. When the push button 5 is thereafter pressed in as shown in FIG. 4B, the push button is locked in the pressed-in position thereof and the switch 8 is turned on. At that time, the operating portion 13 of the indication member 12 is disengaged out of the notch 11 of the coupling bar 10 and placed on the top of the bar so that the indication member is moved in a direction A. As a result, the colored indication film 16, being adhered across the through hole 14 faces the indication opening 4, so that the film can be seen as an indicating object through the indication opening. If the lamp 7 is lit, as it may be for position indication in any case, light therefrom passes through the film 16 so that the light can be seen through the indication opening 4.

Since the turned-on and turned-off states of each push-type switch 8 are indicated not by using a light emitting diode but by using the mechanical indication member 12, electric parts such as the light emitting diode and wires therefor do not need to be provided in the switch operation indicator. Therefore, construction and operation of the switch operation indicator is simplified.

Figure 5:
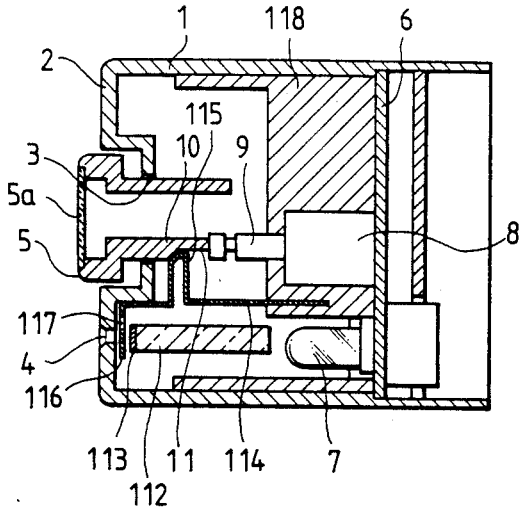
FIG. 5 is a sectional view taken along the line V—V of FIG. 6, showing a switch operation indicator according to another embodiment of the present invention.
Figure 6:
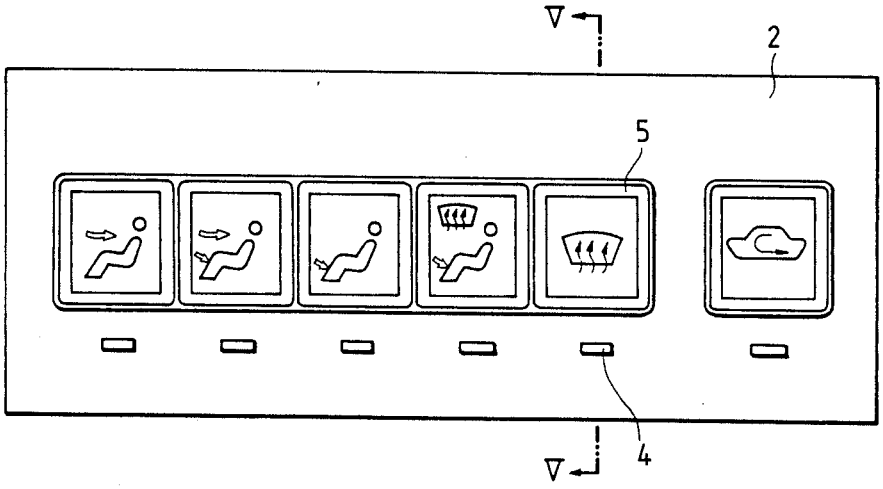
FIG. 6 shows a front view of the switch operation indicator.
Figure 7:
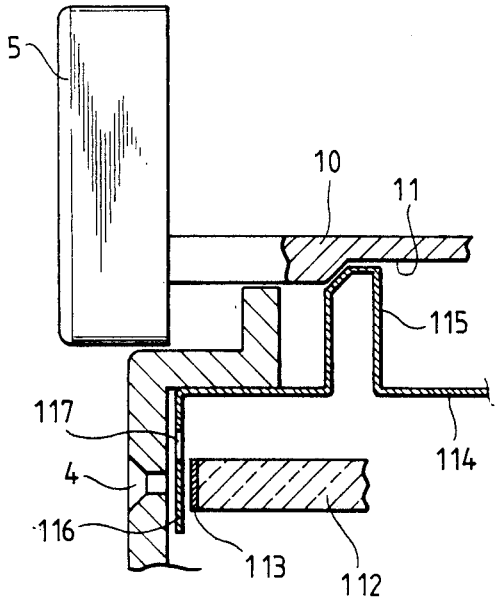
FIGS. 7 and 8 are views illustrating the operation of the switch operation indicator shown in FIG. 5.
Figure 8:
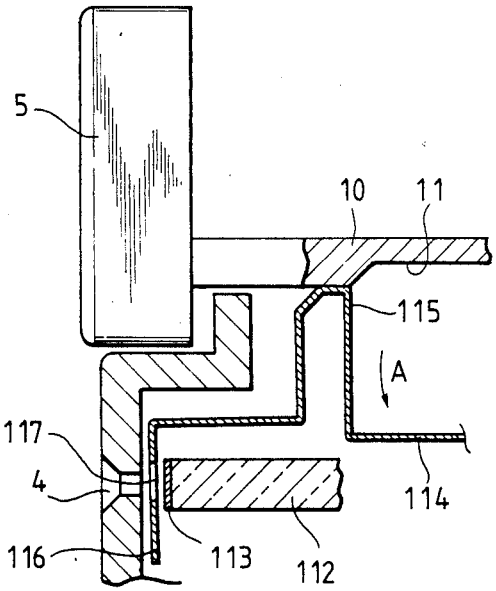

FIGS. 5, 6, 7 and 8 show a switch operation indicator which is another one of the embodiments. The switch operation indicator comprises a frame 1, a panel 2, push button support holes 3, indication openings 4, a lamp cover 6, a lamp 7 and coupling bars 10, similarly to the switch operation indicator shown in FIGS. 1, 2, 3, 4A and 4B. The switch operation indicator shown in FIGS. 5, 6, 7 and 8 also comprises light guides 112 for transmitting light from the lamp 7 to the indication openings 4, colored indication plates 113 secured to the tips of the light guides and facing the indication openings across prescribed gaps, drivers 114 made of spring plates, for example, and secured at the rear ends of the drivers to a holder 118 comprising a portion of the frame 1, and interceptors 116 integrally provided on the tips of the drivers and extending downward from the drivers perpendicularly thereto so that the interceptors can be moved into and out of the gaps between the indication openings and the colored indication plates. An intermediate portion of each of the drivers 114 is formed as an operating portion 115 bent as U, for example. The top of the operating portion 115 is located near the bottom of the coupling bar 10. A through hole 117 is provided in the upper portion of each of the interceptors 116. When each of push buttons 5 is forwardly protruded in an original position as shown in FIGS. 5 and 7, the push-type switch 8 corresponding to the push button is turned off and the operating portion 115 of the driver 114 is engaged in the notch 11 of the coupling bar 10. At that time, the lower portion of the interceptor 116 faces the indication opening 4 so that the colored indication plate 113 cannot be seen through the opening The operation of the switch operation indicator will now be described in a more detailed manner. When the push button 5 is forwardly protruded in the original position as shown in FIGS. 5 and 7, the switch 8 is turned off and the lower portion of the interceptor 116 faces the indication opening 4 so that nothing is indicated through the opening. If the lamp 7 is lit, light from the lamp passes through the push button 5 to indicate the position thereof but does not pass through the indication opening 4, so that the colored indication plate 13 cannot be seen through the opening. When the push button 5 is thereafter pressed in as shown in FIG. 8, the push button is locked in the pressed-in position and the switch 8 is turned on. At that time, the operating portion 115 of the driver 114 is disengaged out of the notch 11 of the coupling bar 10 and placed on the bottom of the coupling bar so that the driver is moved in a direction A. As a result, the colored indication plate 113 faces the indication opening 4 across the through hole 117 so that the plate can be seen as an indicating object through the indication opening. If the lamp 7 is lit, light from the lamp is transmitted through the light guide 112 and passes through the colored indication plate 113 so that the light can be seen through the indication opening 4.

Since electric parts such as a light emitting diode and wires therefor do not need to be provided in the switch operation indicator, the construction and operation of the indicator is simplified.

FIGS. 9, 10, 11A and 11B show a switch operation indicator which is yet another one of the embodiments. The switch operation comprises a frame 1, a panel 2, push button support holes 3, indication openings 4, a lamp cover 6, a lamp 7 and coupling bars 10, similarly to the switch operation indicator shown in FIGS. 1, 2, 3, 4A and 4B. The switch operation indicator shown in FIGS. 9, 10, 11A and 11B also comprises indication drivers 212 made of spring steel plates, for example, and secured to a holder 217 constituting a portion of the frame 1. The intermediate portion of each of the indication drivers 212 is formed as an operating portion 213 bent nearly as a U and located at the top of the operating portion near the bottom of the coupling bar 10. A holder 214 bent nearly as a U is integrally provided at the tip portion **212*a* of the indication driver 212, which is bent perpendicularly to the other portion of the driver. The holder 214 has a through hole 214*a*, which faces the indication opening 4, and a through hole 214*b* facing the through hole 214*a*. An indication film 215 made of a colored plastic material, for example, is secured to the holder 214 behind the through hole 214*a* thereof by caulking, adhering or the like. The rear of the panel 2 has contact portions 216 opposed to the tip portions 212*a* of the indication drivers 212**.

Figure 9:
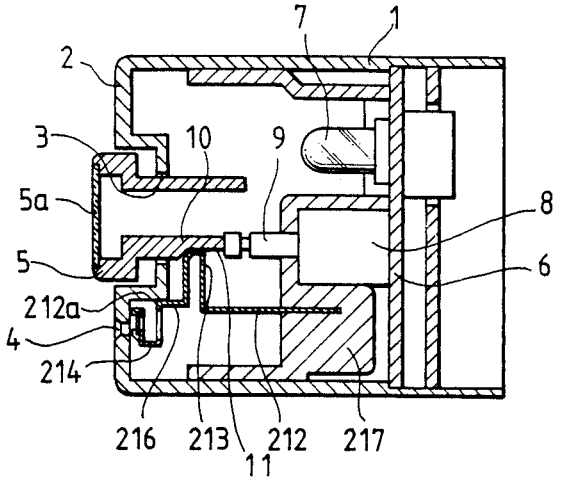
FIG. 9 is a sectional view of a switch operation indicator according to yet another embodiment of the present invention.
Figure 10:
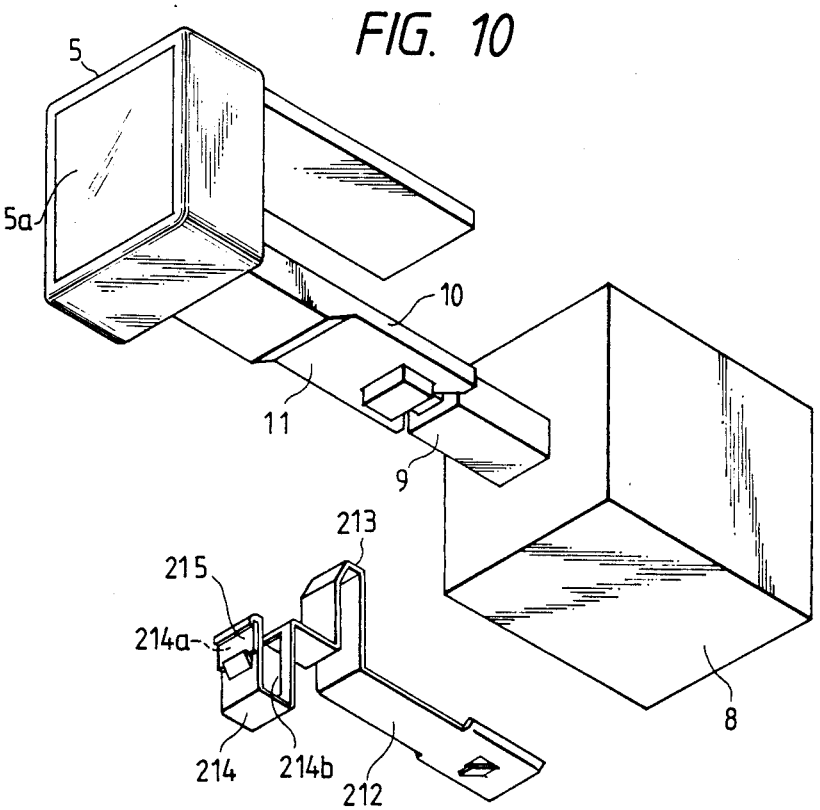
FIGS. 10 and 11 are views illustrating the operation of the switch operation indicator shown in FIG. 9.
Figure 11A:
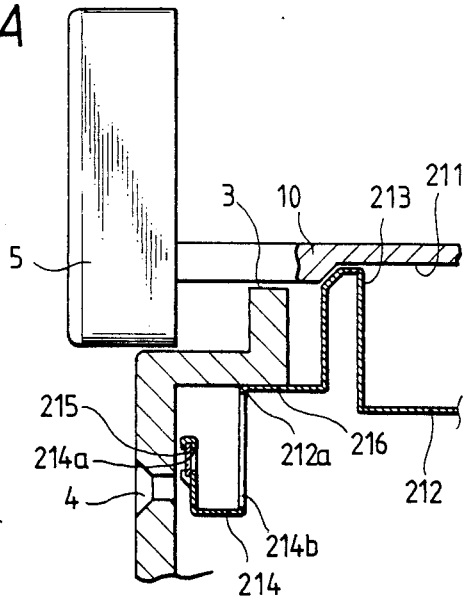
Figure 11B:
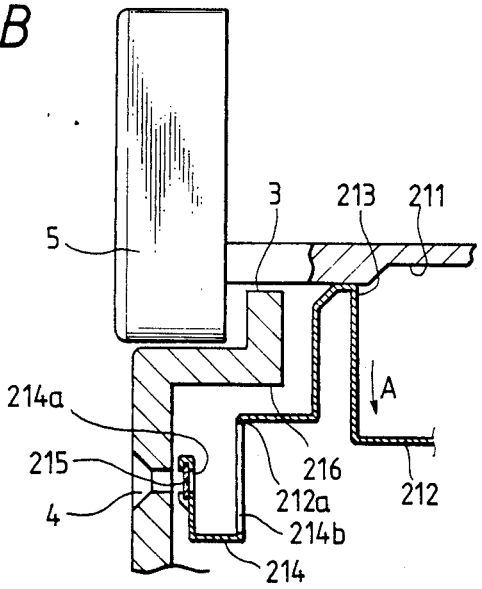

The operation of the switch operation indicator will now be described in detail. When each of push buttons 5 is forwardly protruded in an original position as shown in FIGS. 9 and 11A, the push-type switch 8 corresponding to the push button is turned off and the operating portion 213 of the indication driver 212 is fitted in the notch 11 of the coupling bar 10. At that time, the tip portion **212*a* of the indication driver 212 is located in elastic contact with the contact portion 216 of the panel 2 by the resilient force of the driver, and the portion of the holder 214, which extends below the through hole 214*a* of the holder, faces the indication opening 4 so that nothing is indicated through the opening. If the lamp 7 is lit, light from the lamp passes through the push button 5 to indicate the position thereof but does not pass through the indication opening 4, so that the colored indication film 215 cannot be seen through the opening. When the push button 5 is thereafter pressed in as shown in FIG. 11B, the push button is locked in the pressed-in position and the push-type switch 8 is turned on. At that time, the operating portion 213 of the indication driver 212 is disengaged out of the notch 11 of the coupling bar 10 and placed on the bottom of the bar so that the indication driver is moved in a direction A against the resilient force of the driver. As a result, the colored indication film 215 faces the indication opening 4 so that the film can be seen as an indicating object through the opening. If the lamp 7 is lit, light from the lamp passes through the colored indication film 215 so that the light can be seen through the indication opening 4**.

Since electric parts such as a light emitting diode and wires therefor do not need to be provided in the switch operation indicator, construction and operation of the indicator is simplified.

Since the operating portion 213 of the indication driver 212 is placed on the bottom of the coupling bar 10 and the driver is elastically deformed against the resilient force thereof when the push button 5 is pressed in, the holder 214 and the colored indication film 215 do not undergo a mechanical vibration although the holder and the film are mechanically constituted.

Since the tip portion 212*a* of the indication driver 212 is located in contact with the contact portion 216 of the panel 2 and the driver is elastically deformed against the resilient force thereof when the push button 5 is located in the original position, the holder 214 and the indication driver do not undergo a mechanical vibration although the holder and the driver are mechanically constituted.

Although the above-described embodiments are applied to the push-type switches 8, each of which is forwardly protruded in an original position or locked in a pressed-in position independently of the other switches, the present invention is not confined to the application but may be also applied to push-type switches, each of which is locked in a pressed-in position or unlocked to an original position in conjunction with pressing in one of the other switches.

The present invention is not confined to the above-described embodiments, but may be embodied or practiced in other ways without departing from the spirit or essential character thereof.

We claim:

1. A switch operation indicator comprising a frame fitted with a push-type switch having a drive member locked into a pressed-in position by a first pressing-in action and unlocked and returned to an original position by the next pressing-in action; a push button fitted in said frame so that said push button can be pressed in; a coupling bar for coupling said push button and said drive member to each other and having an operating notched portion; an indication opening provided in said frame adjacent to said button; and an indication member attached to said frame and shaped in complementary fashion with respect to said notched portion to respond to said pressing-in actions to be engaged with or disengaged from said notched portion, said indication member having an indicating portion which swings to face said opening upon the first pressing-in action and swings back to not face said opening upon the next pressing-in action.

2. A switch operation indicator comprising a frame fitted with a push-type switch; an operating member supported with respect to said frame for sliding motion including a pressing-in motion and coupled to a drive member of said switch; a notched portion being provided in said operating member; an indication opening provided in said frame adjacent to said operating member; an indication member provided inside said frame so as to face said opening across a prescribed gap; and a driver including a plate spring and being attached to said frame so as to be swung back or forth corresponding to the pressing-in motion of said operating member, to be respectively engaged with or disengaged from said notched portion, said driver being provided with an interceptor respectively moved into or out of said gap corresponding to the swing of said driver so as to block said indication member from facing said opening or to allow said indication member to face said opening.

3. A switch operation indicator comprising a frame fitted with a push-type switch; an operating member supported with respect to said frame for sliding motion including a pressing-in motion and coupled to a drive member of said switch; a noted portion being provided in said operating member; an indication opening provided in said frame adjacent to said operating member; an indication driver including a plate spring and being attached to said frame so as to be swung back and forth corresponding to the pressing-in motion of said operating member to be respectively engaged with or disengaged from said notched portion, said driver being provided with an indicating portion which respectively faces or does not face said opening; and a contact portion provided in said frame so that said driver comes into elastic contact with said contact portion when said driver is engaged with said notched portion.

* * * * *